US009707445B2

(12) United States Patent
Lee et al.

(10) Patent No.: US 9,707,445 B2
(45) Date of Patent: Jul. 18, 2017

(54) CONTROL LEVER DEVICE FOR AN EXERCISE MACHINE

(71) Applicant: P&F Brother Industrial Corporation, Taichung (TW)

(72) Inventors: Yao-Ting Lee, Taichung (TW); Shih-Wei Li, Taichung (TW); Chih-Kai Li, Taichung (TW)

(73) Assignee: P&F Brother Industrial Corporation, Taichung (TW)

( * ) Notice: Subject to any disclaimer, the term of this patent is extended or adjusted under 35 U.S.C. 154(b) by 102 days.

(21) Appl. No.: 14/837,720

(22) Filed: Aug. 27, 2015

(65) Prior Publication Data

US 2016/0236037 A1 Aug. 18, 2016

(30) Foreign Application Priority Data

Feb. 17, 2015 (TW) ..... 104202839 U

(51) Int. Cl.
*A63B 24/00* (2006.01)

(52) U.S. Cl.
CPC ..... *A63B 24/0087* (2013.01)

(58) Field of Classification Search
CPC . A63B 21/0058; A63B 24/00; A63B 24/0087; A63B 22/0605; A63B 2024/0093; A63B 2230/06; A63B 22/02; A63B 22/0023; A63B 24/0062; A63B 2220/17; A63B 2220/51; A63B 21/4035; A63B 2220/13; A63B 2225/50; A63B 2024/0065; A63B 2024/0068; A63B 2220/833; A63B 2230/062; A63B 22/025; A63B 24/0075; A63B 21/00069; A63B 2208/0233; A63B 21/4033; A63B 2225/20; A63B 2225/30; A63B 22/0242
USPC ..... 482/1–9
See application file for complete search history.

(56) References Cited

U.S. PATENT DOCUMENTS

| | | | | |
|---|---|---|---|---|
| 5,910,070 | A * | 6/1999 | Henry | A63B 21/072 482/108 |
| 6,719,668 | B1 * | 4/2004 | Huang | A63B 22/0242 482/3 |
| 8,414,458 | B2 * | 4/2013 | Hsieh | A63B 21/0058 482/4 |
| 9,399,500 | B1 * | 7/2016 | Hashimoto | B62M 9/122 |
| 9,475,542 | B2 * | 10/2016 | Marioni | B62L 3/02 |
| 2008/0096725 | A1 * | 4/2008 | Keiser | A63B 21/0051 482/8 |
| 2010/0022354 | A1 * | 1/2010 | Fisher | A63B 22/0605 482/8 |
| 2015/0290490 | A1 * | 10/2015 | Badarneh | A63B 22/0023 482/6 |

* cited by examiner

*Primary Examiner* — Andrew S Lo
(74) *Attorney, Agent, or Firm* — Trop Pruner & Hu, P.C.

(57) ABSTRACT

A control lever device is adapted to be mounted on an exercise machine, and includes at least one control lever unit. The control lever unit has a frame seat adapted to be disposed on a handle unit of the exercise machine, a shaft, at least one sensor disposed on the frame seat, a control lever, and a resilient member mounted on the frame seat. The control lever has a seat-connecting portion pivoted on the shaft, a trigger portion adjacent to the sensor, and a lever portion turnable to actuate pivotal movement of the control lever so that the sensor is triggered by the trigger portion to generate a control signal. The resilient member resiliently positions the trigger portion to retain a constant distance from the sensor.

9 Claims, 8 Drawing Sheets

CONTROL LEVER DEVICE FOR AN EXERCISE MACHINE

CROSS REFERENCE TO RELATED APPLICATION

This application claims priority of Taiwanese Patent Application No. 104202839, filed on Feb. 17, 2015, the disclosure of which is incorporated herein by reference.

FIELD

The disclosure relates to a control lever device, more particularly to a control lever device for an exercise machine.

BACKGROUND

Referring to FIG. 1, a conventional exercise machine 1 is illustrated, which includes two handlebars 11 and two press buttons 12. Each press button 12 is mounted on a top end of a respective one of the handlebars 11, and serves to adjust parameters of the exercise machine 1, such as resistance, speed, and so on.

As such, a user generally presses the press buttons 12 with his/her thumbs to adjust the parameters of the exercise machine 1. However, with such structural design, it may be difficult for the user to maintain a firm grip on the handlebars 11 during the button-pressing process, which does not follow the principles of ergonomics. Moreover, the press buttons 12 are generally dome-type switches made of silicone rubber, which are prone to eventually fracture or lose electrical contact with their inner circuit boards (not shown). Furthermore, if any part of the press button 12 malfunctions, the entire press button 12, along with its inner circuit board, may need to be replaced, which is fairly inconvenient.

SUMMARY

Therefore, the object of the disclosure is to provide a control lever device that can offer functional reliability and ergonomic convenience for the exercise machine user.

Accordingly, a control lever device is adapted to be mounted on an exercise machine. The exercise machine includes a handle unit. The control lever device includes at least one control lever unit that has a frame seat adapted to be disposed on the handle unit, a shaft disposed on the frame seat, at least one sensor disposed on the frame seat, a control lever, and a resilient member. The control lever has a seat-connecting portion that has a pivot end pivoted on the shaft, a trigger portion that extends from the seat-connecting portion and that is adjacent to the sensor, and a lever portion that extends from the seat-connecting portion. The lever portion is turnable to actuate pivotal movement of the control lever, so that the at least one sensor is triggered by the trigger portion to generate a control signal. The resilient member is mounted on the frame seat and resiliently positions the trigger portion to maintain a constant distance from the at least one sensor.

BRIEF DESCRIPTION OF THE DRAWINGS

Other features and advantages of the disclosure will become apparent in the following detailed description of the embodiments with reference to the accompanying drawings, of which.

DETAILED DESCRIPTION OF THE EMBODIMENTS

Figure 1:
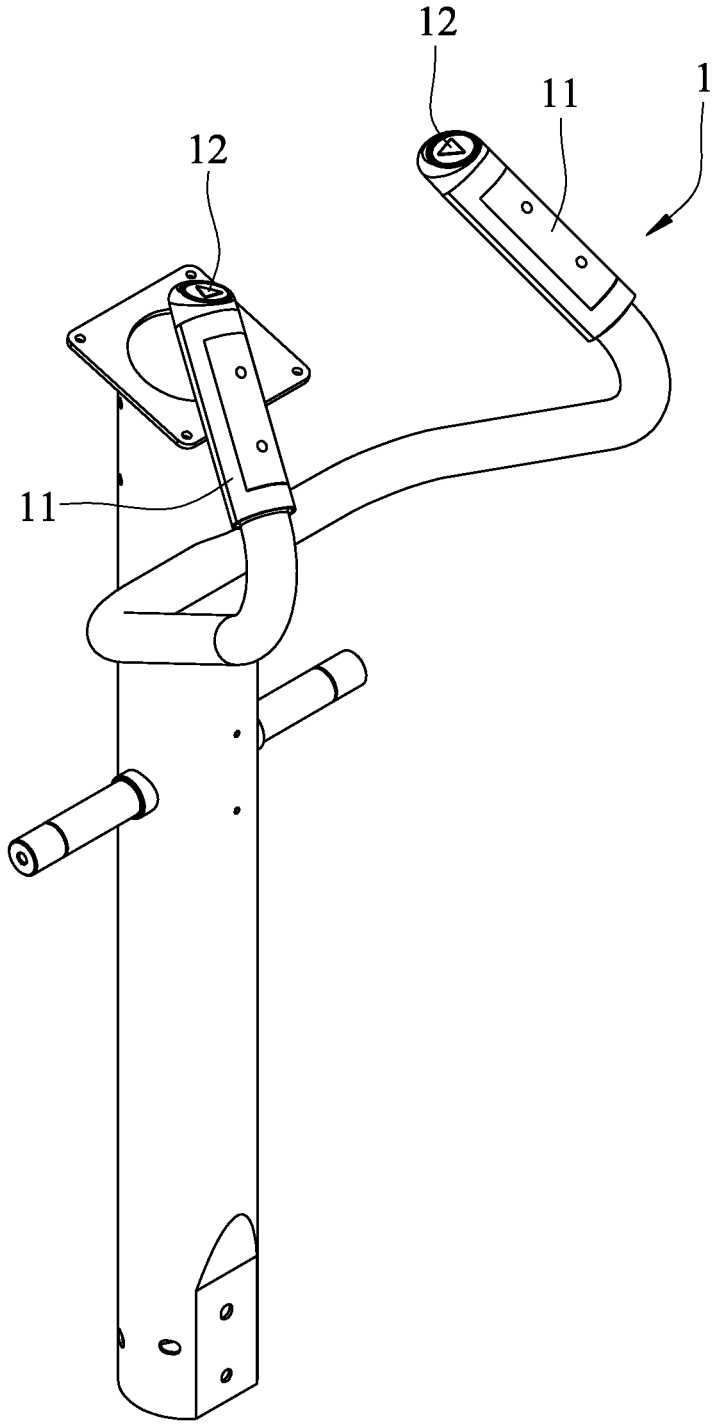
FIG.1 PRIOR ART
FIG. 1 is a perspective view illustrating a conventional exercise machine.

Before the present invention is described in greater detail, it should be noted that like elements are denoted by the same reference numerals throughout the disclosure.

Figure 2:
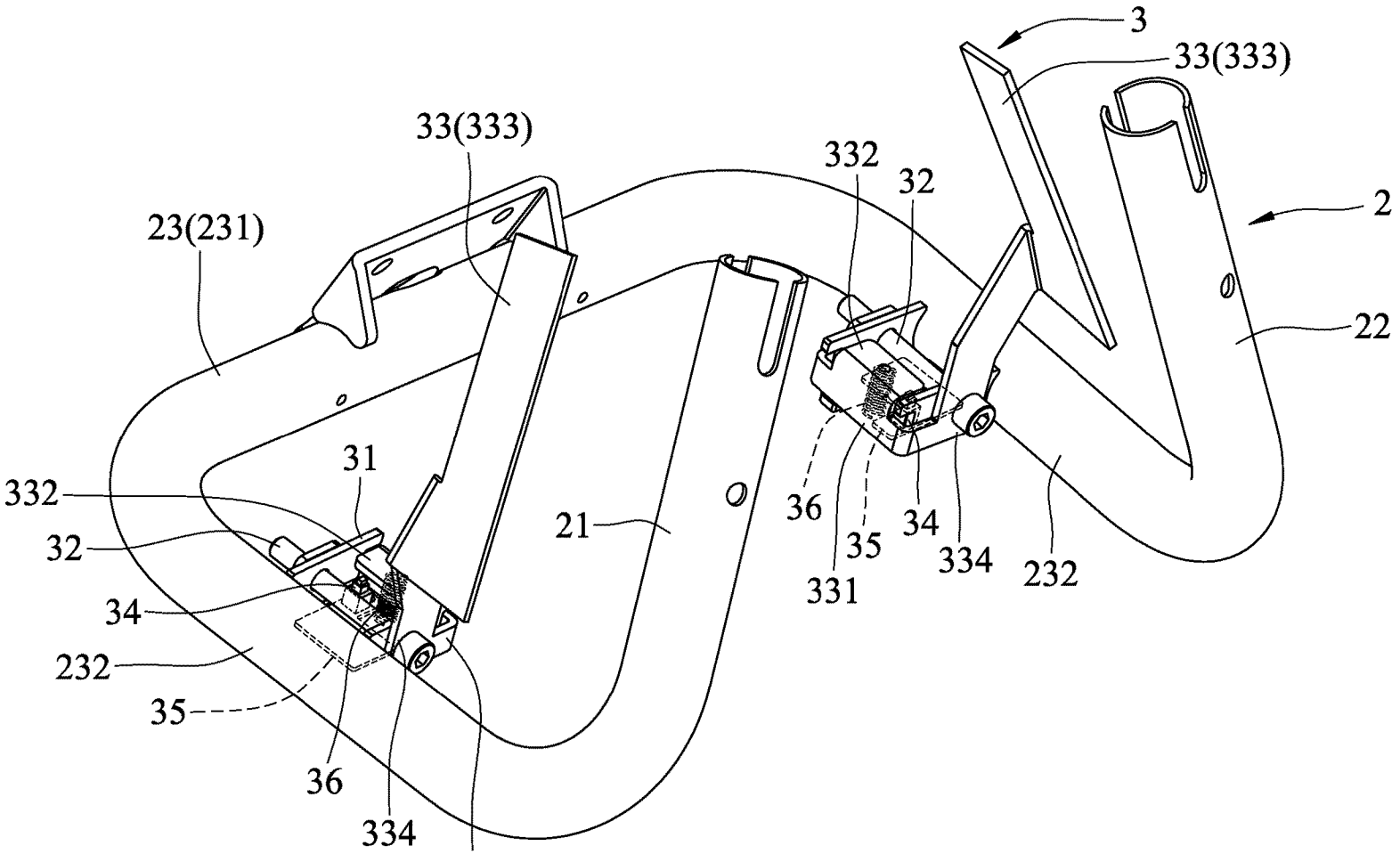
FIG. 2 is a perspective view illustrating a first embodiment of a control lever device according to the disclosure, which is mounted on a handle unit of an exercise machine.
Figure 3:
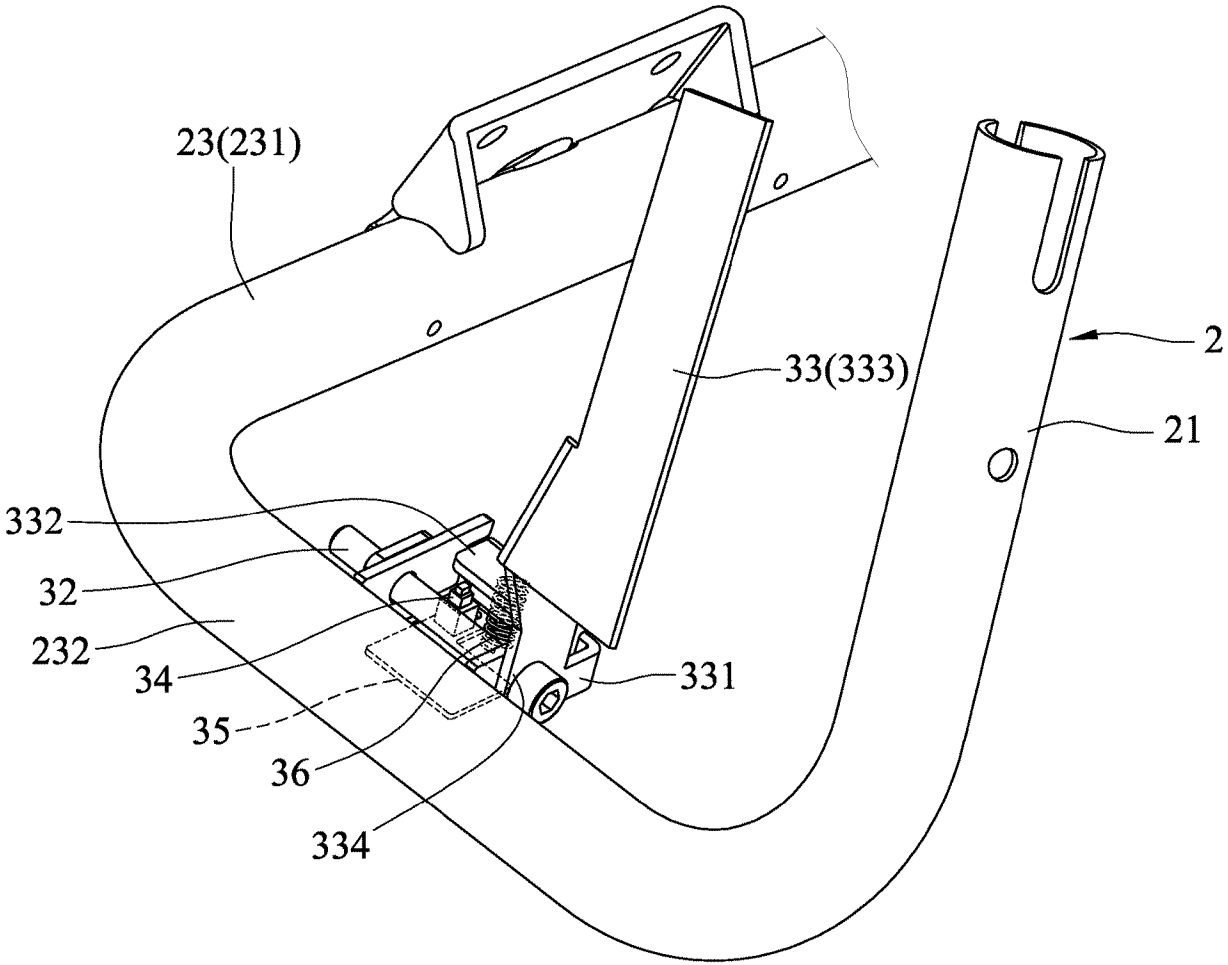
FIG. 3 is a fragmentary perspective view illustrating a left half of the first embodiment and the handle unit.
Figure 4:
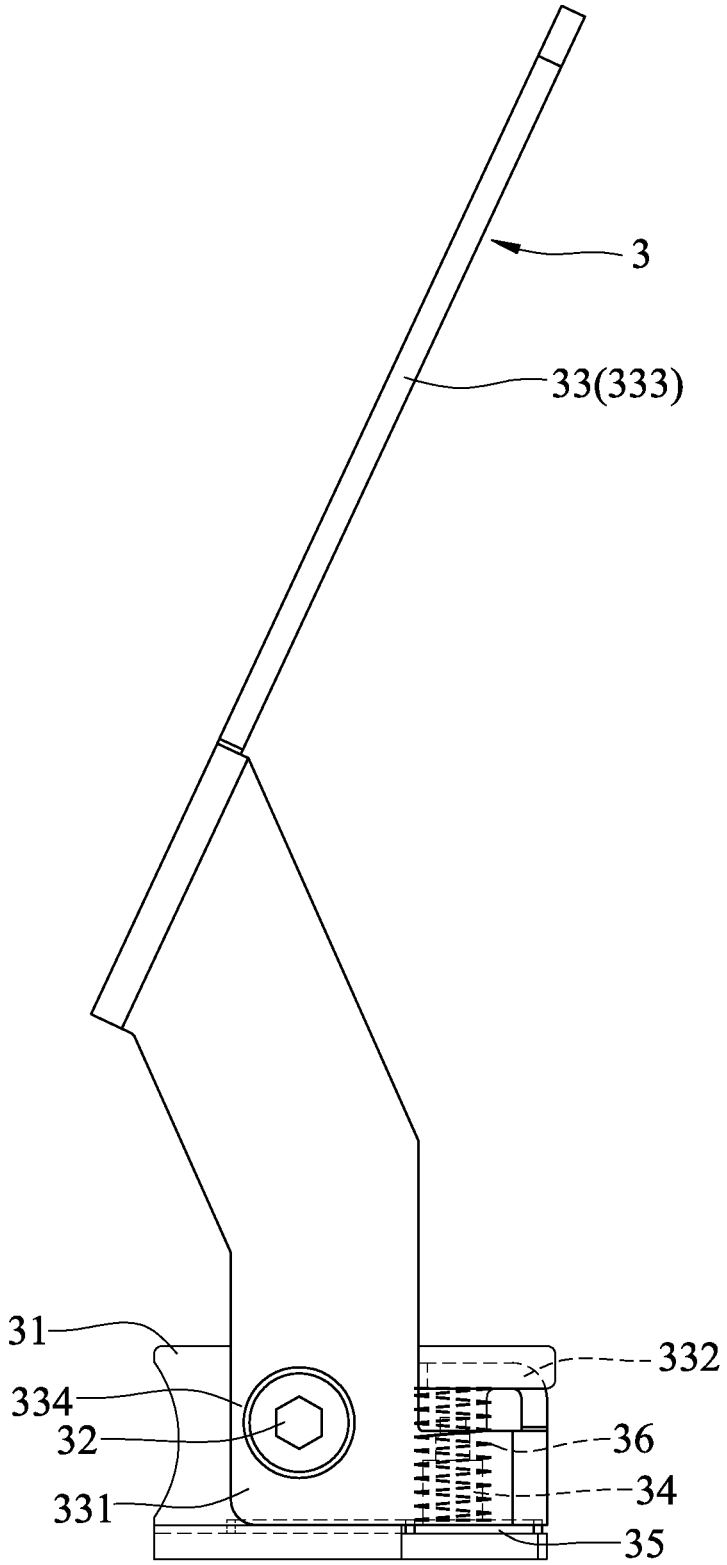
FIG. 4 is a side view illustrating a control lever unit of the first embodiment before being turned.

Referring to FIGS. 2 to 4, a first embodiment of a control lever device according to the disclosure is illustrated, which is adapted to be mounted on an exercise machine. The exercise machine includes a handle unit 2 that has a left handlebar 21, a right handlebar 22, and a connecting bar 23 interconnecting the two handlebars 21, 22. The connecting bar 23 is U-shaped, and has a main bar segment 231, and two extending bar segments 232 that extend respectively from opposite ends of the main bar segment 231 and that are connected respectively to the handlebars 21, 22. Furthermore, the two handlebars 21, 22 extend respectively, obliquely and upwardly from the extending bar segments 232 toward each other.

In this embodiment, the control lever device according to the disclosure includes two control lever units 3. Each of the control lever units 3 has a frame seat 31 adapted to be disposed on a respective one of the extending bar segments 232 of the connecting bar 23 of the handle unit 2, a sensor 34 disposed on the frame seat 31, a shaft 32 disposed on the frame seat 31, a control lever 33 pivoted on the shaft 32, an electric circuit 35 disposed on the frame seat 31 and electrically connected to the sensor 34, and a resilient member 36 mounted on the frame seat 31.

The control lever 33 of each control lever unit 3 has a seat-connecting portion 331 that has a pivot end 334 pivoted on an end the shaft 32, a trigger portion 332 that extends from the seat-connecting portion 331 and that is adjacent to the sensor 34, and a lever portion 333. In more detail, the trigger portion 332 extends from the pivot end 334 of the seat-connecting portion 331 and over the sensor 34 and the resilient member 36.

In this embodiment, the shaft 32 of each control lever unit 3 is a hex socket screw. However, in other embodiments, the shaft 32 may be other fasteners on which the control lever 33 is pivoted.

Figure 5:
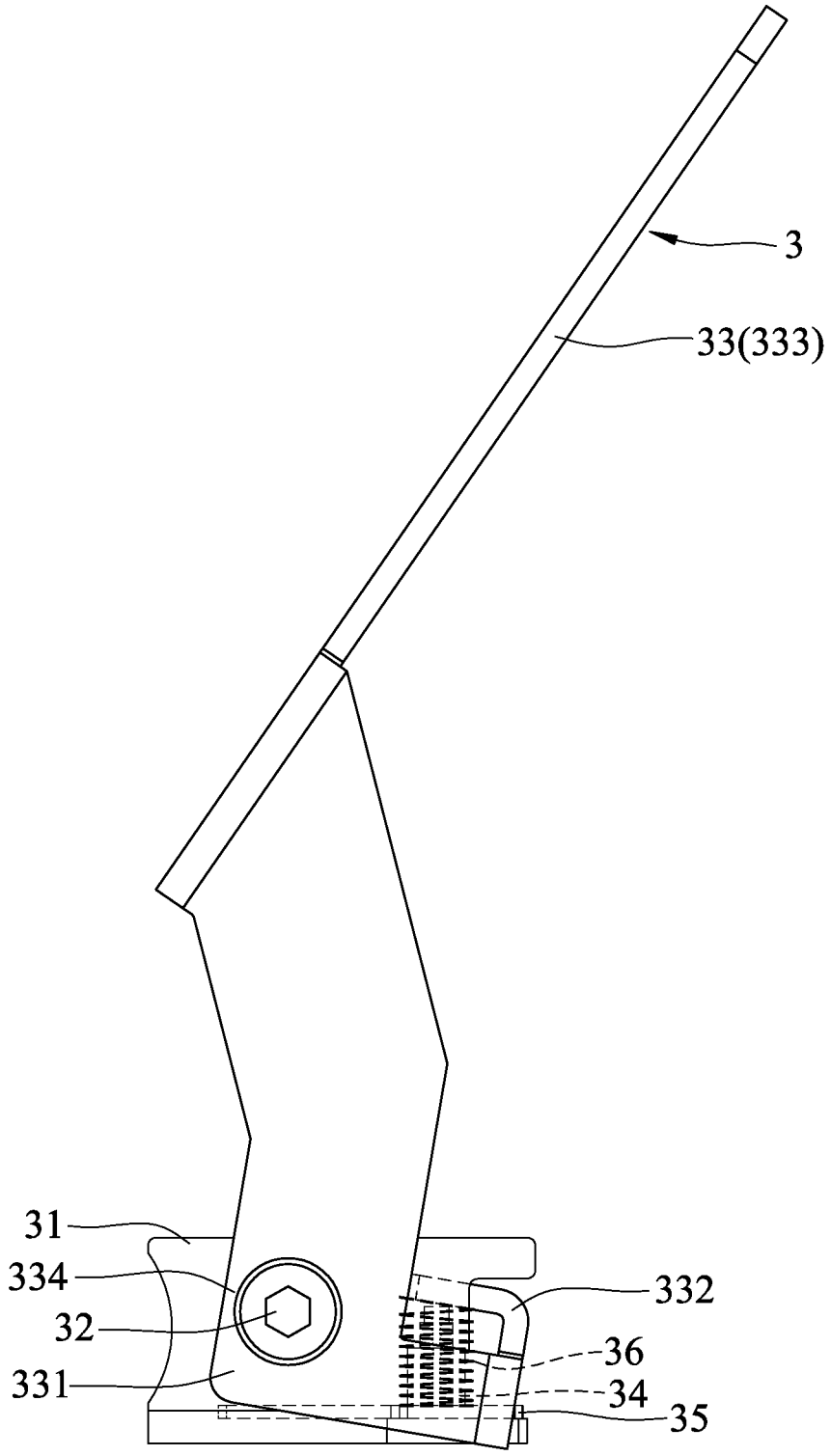
FIG. 5 is a side view illustrating the control lever unit of the first embodiment that is turned to press upon a sensor.

The pivot end 334 of each control lever unit 3 of this embodiment is adapted to be disposed between the trigger portion 332 and a respective one of the extending bar segments 232 of the connecting bar 23. As such, as further shown in FIG. 5, the lever portion 333 of the control lever 33 of the left one of the control lever units 3 is turnable relative to the left handlebar 21 in a clockwise direction to actuate pivotal movement of the control lever 33, so that the sensor 34 is pressed and triggered by the trigger portion 332 to generate a control signal. The control signal is then sent to the electric circuit 35 for adjusting parameters of the exercise machine, such as resistance, speed and so on. On the other hand, the control lever 33 of the right one of the control lever units 3 is turnable relative to the right handlebar 22 in a counterclockwise direction for triggering the sensor 34.

In this embodiment, the sensor 34 of each of the control lever units 3 is a limit switch for convenience in sensing the pivotal movement of the control lever 33. However, the method by which the sensors 34 are triggered is not limited by the embodiment. For example, for each control lever unit 3, the trigger portion 332 of the control lever 33 may trigger the sensors 34 by moving away from contact therewith. Furthermore, the sensor 34 of each of the control lever units 3 may also be altered to be proximate switches, miniature snap-action switches, reed switches, and so on.

For each of the control lever units 3, the resilient member 36 resiliently positions the trigger portion 332 to maintain a constant distance from the sensor 34, and is disposed for returning the control lever 33 to a normal position after turning. In this embodiment, each of the resilient members 36 is a spring.

In use, while holding the handlebars 21, 22 with his/her two hands, a user can still easily loosen one of his/her index, middle, ring and little fingers to push the control levers 33 against the resilient forces of the resilient members 36 to contact the sensors 34 while continuing to grasp the handlebars 21, 22 with the rest of his/her fingers. When the control levers 33 are released, the resilient members 36 automatically bias the control lever 33 away from the sensors 34.

Figure 6:
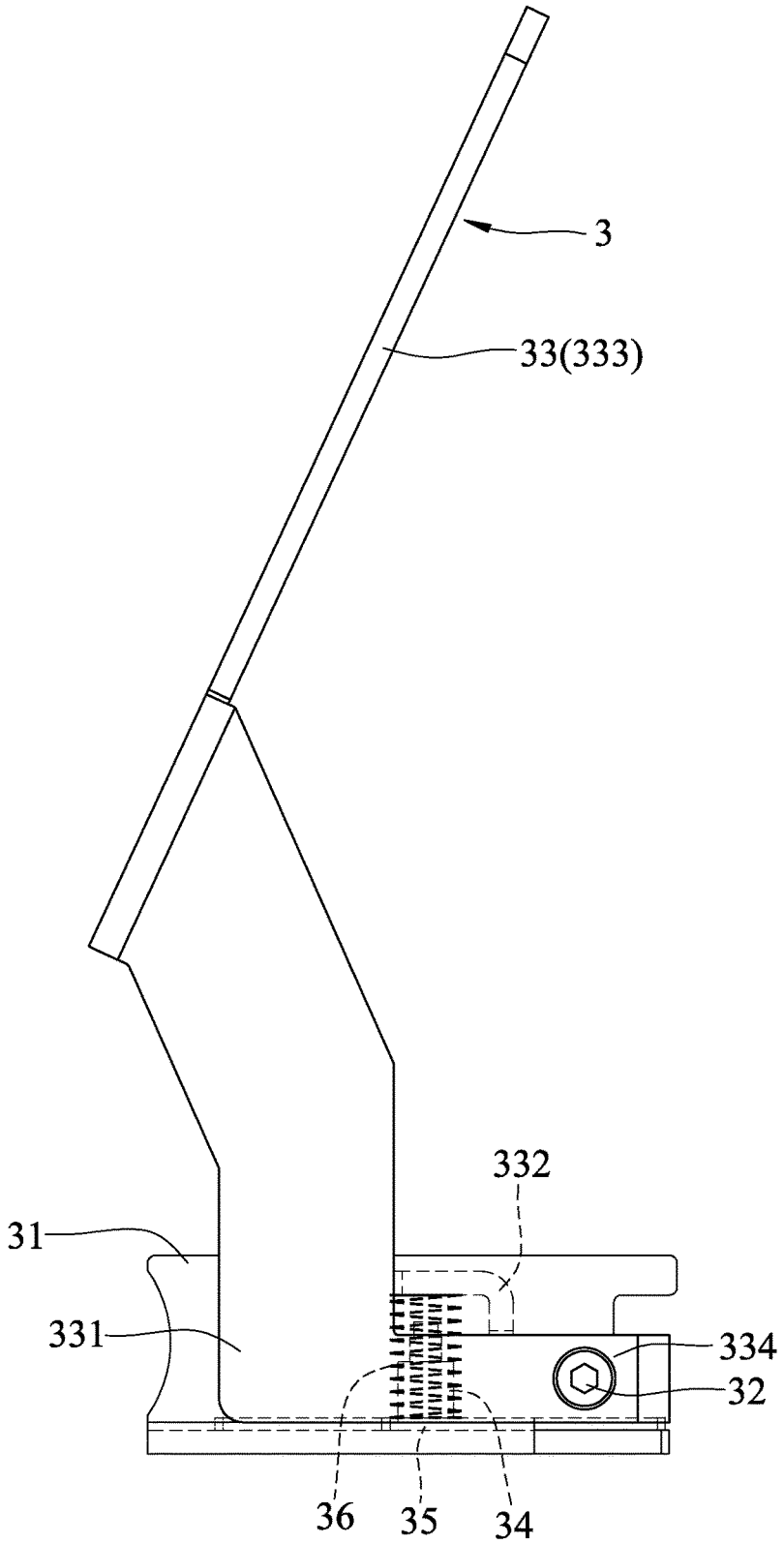
FIG. 6 is a side view illustrating a control lever unit of a second embodiment of the control lever device according to the disclosure.

Referring to FIG. 6, a second embodiment of the control lever device according to the disclosure is illustrated. The second embodiment has a similar structure as that of the first embodiment, but is different in that the trigger portion 332 of each control lever 33 is adapted to be disposed between the pivot end 334 and a respective one of the extending bar segments 232 of the connecting bar 23. Therefore, the lever 33 of the left one of the control lever units 3 is turnable relative to the left handlebar 21 in a counterclockwise direction to press the sensor 34. For the right one of the control lever units 3, the control lever 33 is turnable relative to the right handlebar 22 in a clockwise direction to press the sensor 34.

Figure 7:
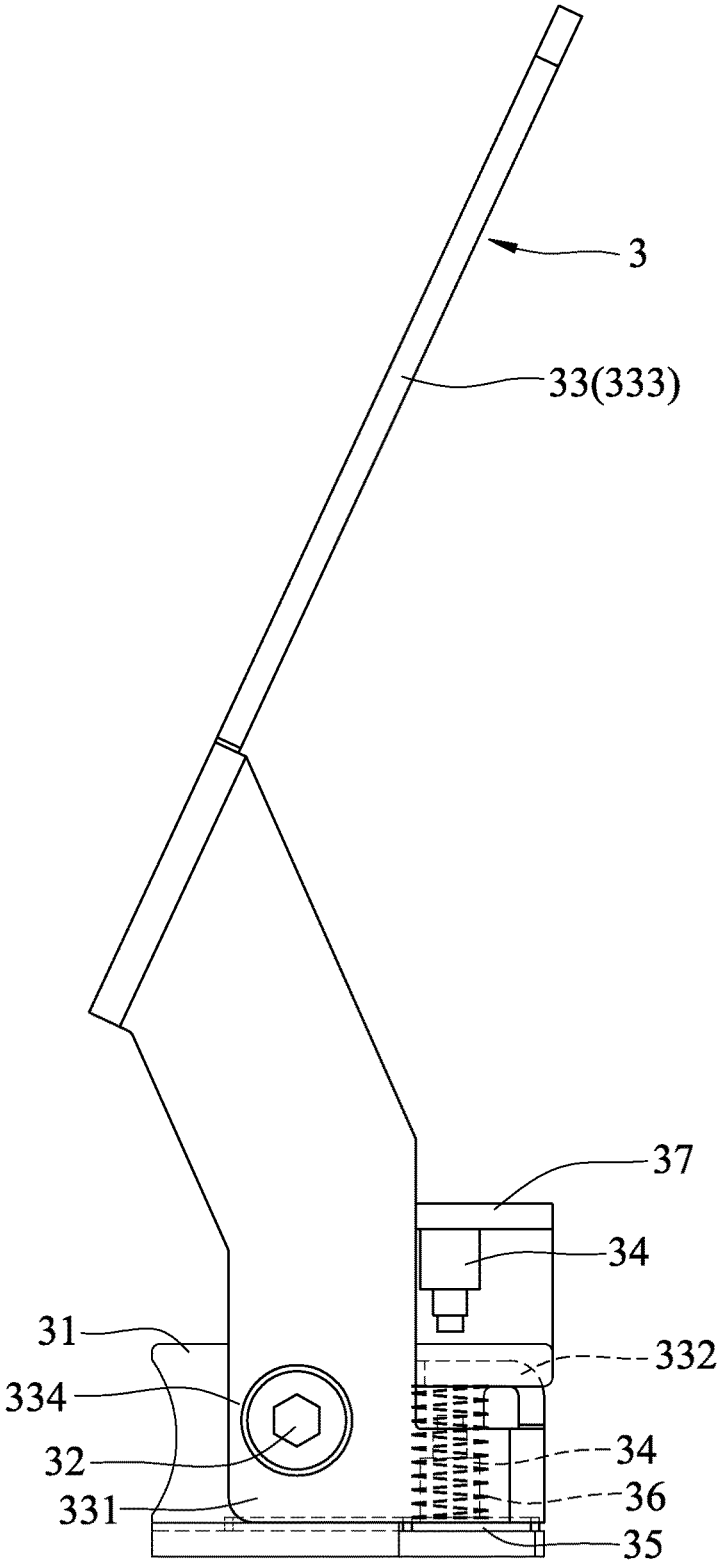
FIG. 7 is a side view illustrating a control lever unit of a third embodiment of the control lever device according to the disclosure.

Referring to FIG. 7, a third embodiment of the control lever device according to the disclosure is illustrated. The third embodiment possesses a similar structure as that of the first embodiment, but is different in that each of the control lever units 3 further includes a mounting seat 37 that is connected to the frame seat 31, and that each of the control lever units 3 includes two of the sensors 34 disposed respectively on the frame seat 31 and the mounting seat 37 and respectively at two opposite sides of the trigger portion 332. As such, the sensor 34 of the left one of the control lever units 3 on the frame seat 31 can be pressed for sending a control signal when the control lever 33 is turned clockwise, and the sensor 34 on the mounting seat 37 can be pressed for sending another control signal when the control lever 33 is turned counterclockwise. Therefore, additional functions can be made available to the user of the exercise machine.

Figure 8:
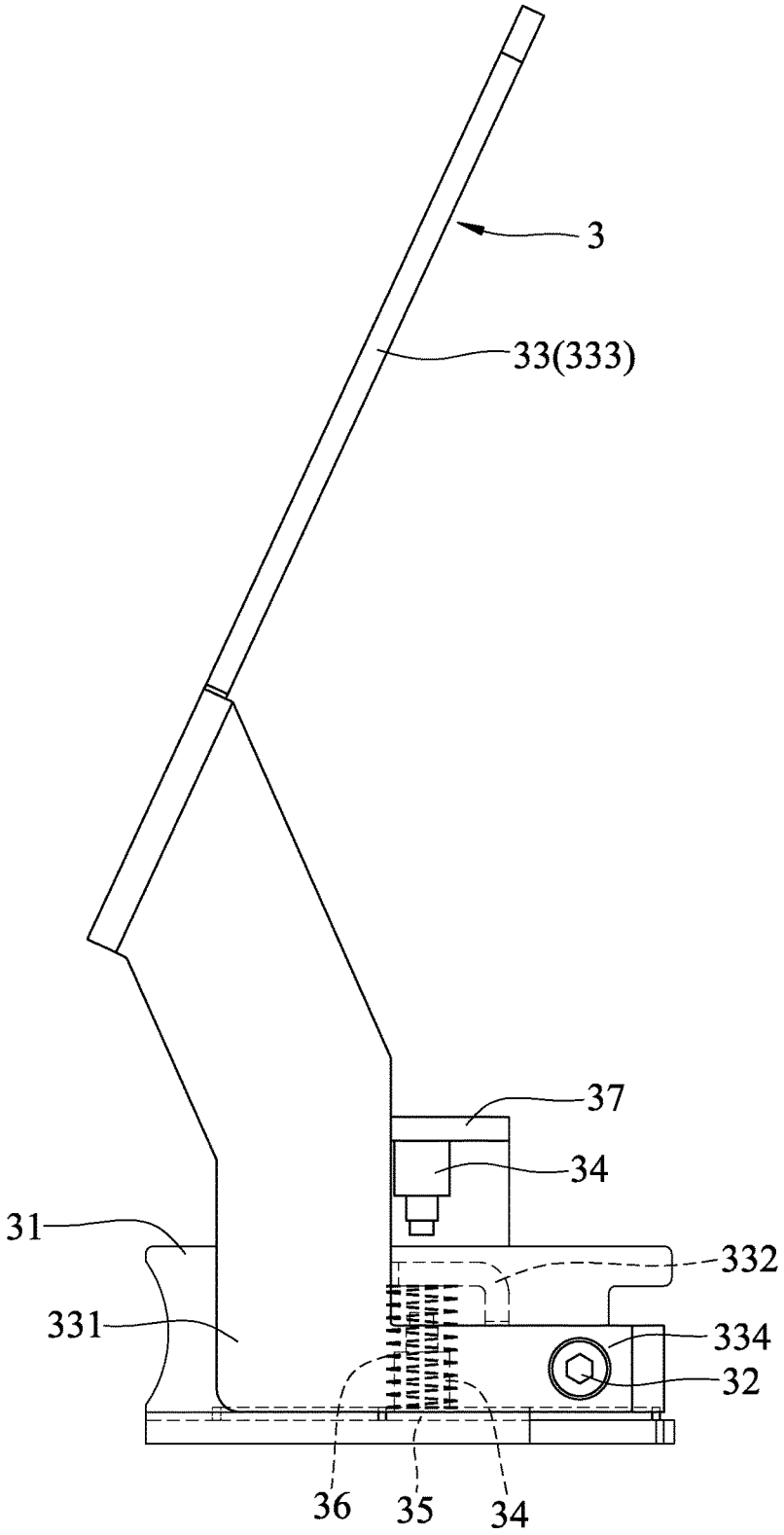
FIG. 8 is a side view illustrating a control lever unit of a fourth embodiment of the control lever device according to the disclosure.

Referring to FIG. 8, a fourth embodiment of the control lever device according to the disclosure is illustrated. The fourth embodiment possesses a similar structure as that of the third embodiment, but is different in that the trigger portion 332 of each control lever 33 is adapted to be disposed between the pivot end 334 and the respective one of the extending bar segments 232 of the connecting bar 23.

In summary view of the foregoing embodiments, the operation of the control lever device 3 of the disclosure is simple and ergonomic for the user due to its placement on the handle unit 2. Furthermore, as a mechanical-type switch, the control lever device according to the disclosure has long-lasting reliability.

While the present invention has been described in connection with what are considered the exemplary embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A control lever device adapted to be mounted on an exercise machine, the exercise machine including a handle unit, said control lever device comprising:
- at least one control lever unit that has a frame seat adapted to be disposed on the handle unit;
- a shaft disposed on said frame seat;
- at least one sensor disposed on said frame seat;
- a control lever having
  - a seat-connecting portion that has a pivot end pivoted on said shaft,
  - a trigger portion that extends from said seat-connecting portion and that is adjacent to said sensor, and
  - a lever portion that extends from said seat-connecting portion, and that is turnable to actuate pivotal movement of said control lever so that said at least one sensor is triggered by said trigger portion to generate a control signal; and
- a resilient member mounted on said frame seat and resiliently positioning said trigger portion to retain a constant distance from said at least one sensor.

2. The control lever device as claimed in claim 1, the handle unit having two handlebars, and a connecting bar that has a main bar segment and two extending bar segments extending respectively from opposite ends of the main bar segment and connected respectively to the handlebars, wherein said control lever device comprises two of said control lever units that are adapted to be respectively disposed on the extending bar segments.

3. The control lever device as claimed in claim 2, wherein said pivot end of said seat-connecting portion of said control lever of each of said control lever units is adapted to be disposed between said trigger portion of said control lever and a respective one of the extending bar segments of the connecting bar.

4. The control lever device as claimed in claim 3, wherein:
- each of said control lever units further includes a mounting seat that is connected to said frame seat; and
- each of said control lever units includes two of said sensors disposed respectively on said frame seat and said mounting seat and respectively at two opposite sides of said trigger portion.

5. The control lever device as claimed in claim 2, wherein said trigger portion of said seat-connecting portion of each of said control lever of each of said control lever units is adapted to be disposed between said pivot end and a respective one of the extending bar segments of the connecting bar.

6. The control lever device as claimed in claim 5, wherein:

each of said control lever units further includes a mounting seat that is connected to said frame seat; and each of said control lever units includes two of said sensors disposed respectively on said frame seat and said mounting seat and respectively at two opposite sides of said trigger portion.

7. The control lever device as claimed in claim 1, wherein said at least one sensor is a limit switch.

8. The control lever device as claimed in claim 1, wherein said at least one control lever unit further includes an electric circuit that is disposed on said frame seat and that is electrically connected to said at least one sensor.

9. The control lever device as claimed in claim 1, wherein said resilient member is a spring.

* * * * *